US007055444B2

(12) United States Patent
Stucki et al.

(10) Patent No.: US 7,055,444 B2
(45) Date of Patent: Jun. 6, 2006

(54) ARRANGEMENT FOR CHANGING THE BOBBIN OF A SEWING OR EMBROIDERY MACHINE

(75) Inventors: André Stucki, Steckborn (CH); Michael Berger, Constance (DE)

(73) Assignee: Fritz Gegauf Aktiengesellschaft BERNINA-Nahmaschinenfabrik, Steckborn (CH)

( * ) Notice: Subject to any disclaimer, the term of this patent is extended or adjusted under 35 U.S.C. 154(b) by 0 days.

(21) Appl. No.: 10/894,716

(22) Filed: Jul. 20, 2004

(65) Prior Publication Data

US 2005/0045084 A1 Mar. 3, 2005

(30) Foreign Application Priority Data

Aug. 29, 2003 (CH) ..... 1478/03

(51) Int. Cl.
*D05B 57/26* (2006.01)

(52) U.S. Cl. ..... 112/180

(58) Field of Classification Search ..... 112/180, 112/181, 182, 183, 186, 189, 196, 201, 231
See application file for complete search history.

(56) References Cited

U.S. PATENT DOCUMENTS

| | | | | |
|---|---|---|---|---|
| 2,420,536 | A * | 5/1947 | Hohmann | 112/181 |
| 3,031,989 | A * | 5/1962 | Baumotte et al. | 112/180 |
| 3,072,084 | A * | 1/1963 | Vigorelli | 112/180 |
| 3,882,805 | A * | 5/1975 | Bianchi | 112/180 |

* cited by examiner

*Primary Examiner*—Danny Worrell
(74) *Attorney, Agent, or Firm*—Volpe and Koenig, P.C.

(57) ABSTRACT

An arrangement for changing bobbins in sewing and embroidery machines is arranged on the cover (13) on the lower arm of the sewing machine (1). With a push-button (45) and a slide (19), the bobbin case (71) with the bobbin (73) lying therein is released from the hook base (75) and made accessible to outside of the sewing machine (1) when the cover (13) is opened.

6 Claims, 7 Drawing Sheets

ARRANGEMENT FOR CHANGING THE BOBBIN OF A SEWING OR EMBROIDERY MACHINE

BACKGROUND

The invention is directed to an arrangement for changing the bobbin of a sewing or embroidery machine, and more particularly relates to a release and hold means for moving the bobbin out of the hook base and for conveying the bobbin into a changing position.

The maximum amount of thread that can be stored on a bobbin for a sewing or embroidery machine is extremely limited due to geometric conditions. The amount that can be stored covers only a fraction of the amount of thread that can be stored on the bobbin for the needle thread and therefore must be changed often. Another disadvantage of this small amount of thread is that changing the bobbin, which is usually held in a bobbin case mounted in the hook, is very involved. Access to the hook, which is located underneath the needle plate, is naturally poor and especially during stitching or quilting, access to the bobbin is made more difficult by the material to be sewn lying on the needle plate.

In the state of the art, the following various attempts have already tried to improve these conditions.

From DE-10 032 011, it is known to manufacture the bobbin at least partially from ferromagnetic material, so that it can be moved out of the hook by a magnetic discharge element. This known arrangement requires bobbins manufactured especially for this discharge arrangement and it cannot use conventional bobbins made from non-magnetic material, such as stainless steel and plastic, which are most readily available. For this known arrangement, not only the bobbin, but also the hook must be configured correspondingly in order to retain the ferromagnetic bobbin by magnetic attraction within its housing during sewing. The retention is realized not by a positive-fit, but instead only by a force-fit by means of magnetic force of attraction. Consequently, this known bobbin discharge arrangement requires not only special bobbins, but also a correspondingly formed hook.

From EP-A1-0829 565, a hook exchanger is further known, which is suitable for commercial sewing machines. A handling device removes the bobbins filled with thread and inserted into a bobbin case from a rotary star and inserts them into the hook of the machine. In the reverse sequence, the bobbin case containing an empty thread bobbin is removed from the machine beforehand and conveyed to the handling device. Such handling devices are on one hand expensive and only usable in commercial machines. In addition, they can by used only to a limited extent in free-arm household sewing machines, because the free arm no longer allows sewing of tubular goods due to the handling device.

From CH 369955, a bobbin removal arrangement is further known, which enables the removal of the bobbin by sliding a cover on the sewing table. This arrangement, like the first, requires a specially formed hook and a complicated mechanism arranged underneath the needle plate in the machine housing. If something goes wrong, the removal of the bobbin by hand is barely possible without the help of a technician.

SUMMARY

The object of the present invention is to create a method and an arrangement for changing bobbins, which can be used in sewing machines with conventional hook systems.

This object is realized by an arrangement according to the features of the invention, wherein the release and hold means for removing the bobbin from the hook base are mounted on a support, which is arranged so that it can move out of the free arm through an opening in the free arm exposed by an opened cover. Advantageous configurations of the invention are described in detail below.

The arrangement according to the invention can be built directly or indirectly on a flap, like those present for free-arm sewing machines or embroidery machines. Consequently, no structural changes to the design and placement of the hook system and the sewing machine are required. The only necessary adaptation is that the pivoting lever for releasing the latch on the bobbin case can be eliminated. The arrangement can be operated without studying a manual simply by activating a button. Incorrect manipulations are thus excluded. In one preferred configuration of the invention, the push-button and activation button can be replaced by an electromagnetic or mechanical drive, which is activated, e.g., by opening the flap.

BRIEF DESCRIPTION OF THE DRAWINGS

The invention is described in more detail with reference to an illustrated embodiment. Shown are.

DETAILED DESCRIPTION OF THE PREFERRED EMBODIMENTS

Figure 1:
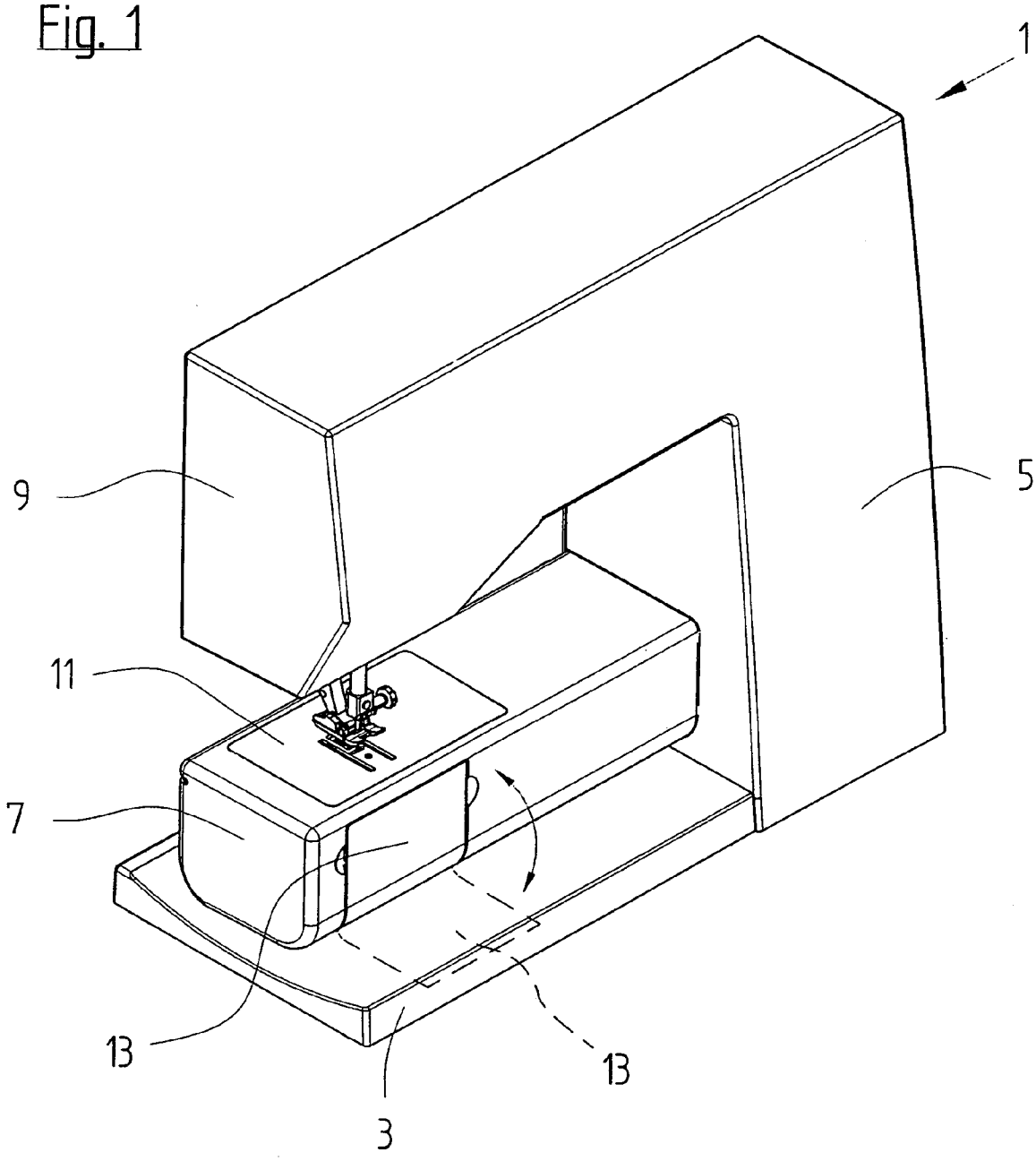
FIG. 1 is a schematic, perspective view of a household sewing machine.

In FIG. 1, a household sewing machine 1 with a base 3, a stand 5 mounted and supported on the base 3, and a lower arm or free arm 7, as well as an upper arm 9, mounted on the stand can be seen purely schematically. At the front end of the free arm 7 in the region of the needle plate 11, a cover 13, also called a flap, can be seen in the closed state and with broken lines in the open, i.e., pivoted downwards, state. The cover 13 is hinged at the bottom side of the free arm 7. The cover 13 could also be mounted, similar to a drawer, so that it can be pulled out of the bottom arm (7). It is used to guarantee access by an operator of the sewing machine 1 to a bobbin 73 located in the lower arm. The arrangement according to the invention for changing bobbins 73 is not shown on the folded-down cover 13, which is shown only schematically in FIG. 1. Detailed views of the arrangement can be seen in FIGS. 3–7.

Obviously, the changing arrangement could also be located on a support independent of the cover (no illustration).

Figure 2:
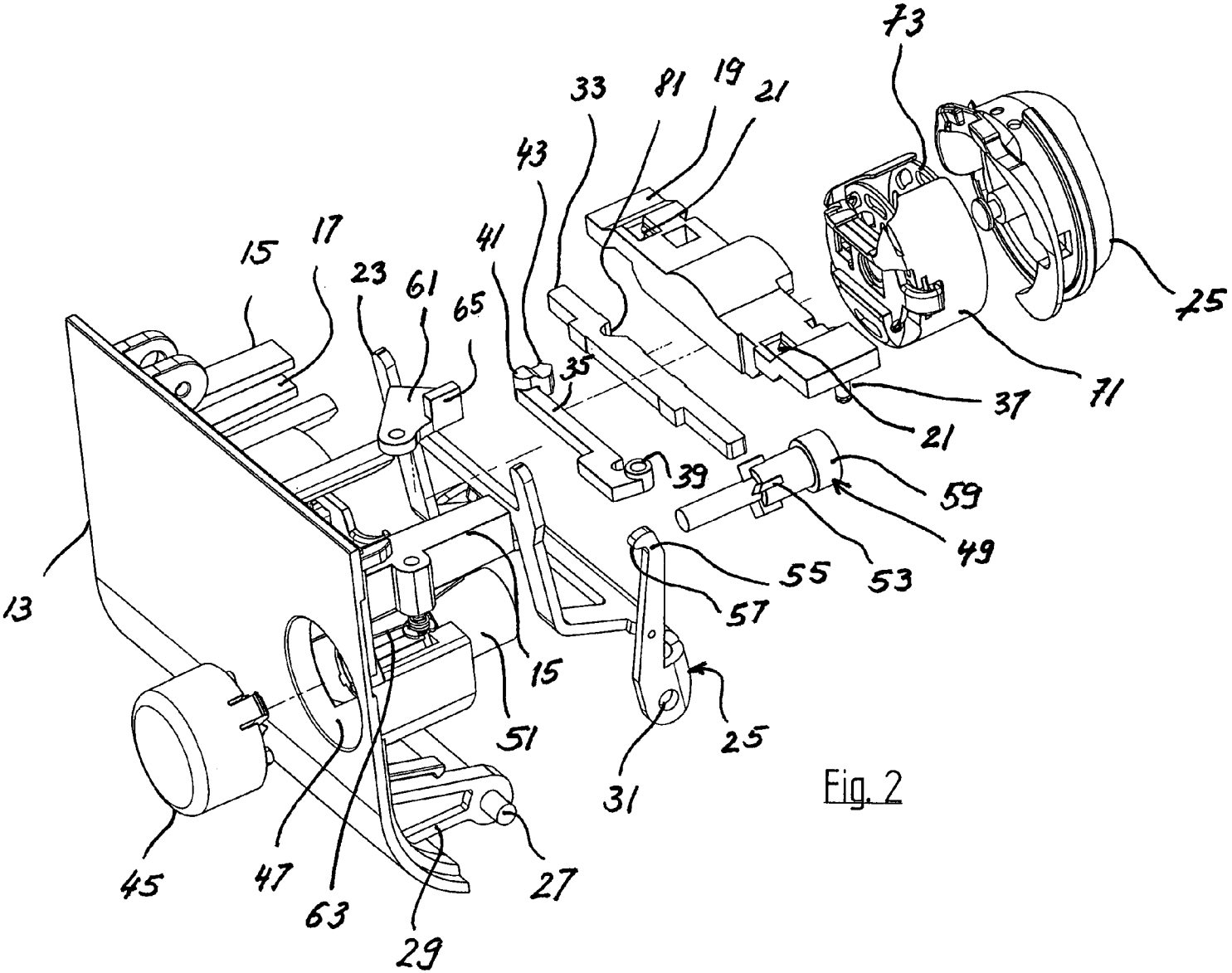
FIG. 2 is an exploded view of the individual parts of the release and hold arrangement of the bobbin case and the hook base.

FIG. 2 shows in turn the cover 13 and in an exploded view the individual parts of the changing arrangement. These are described in detail in the following so that their function when they are assembled into one unit as an changing arrangement can be better understood. Two U-shaped longitudinal guides 15 with opposing grooves 17, in which a slide 19 can move in parallel, sit directly on the cover 13. The ends of two arms 23 of a rocker 25 engage in two recesses 21 on the slide 19. The rocker 25 is supported on two shaft stumps 27, which engage in bore holes 31, so that it can pivot on two pivot brackets 29 on the cover 13.

A crossbar 33 is inserted in the slide 19 so that it can move and is held, among other things, by an unlocking latch 35. The unlocking latch 35 is hinged so that it can pivot on a bolt 37 on the slide 19. The hinge is realized via a socket 39, which is located at one end of the unlocking latch 35. At the other end of the unlocking latch 35, there is a guidance cam 41 and a catch hook 43 opposite this cam.

In the cover 13, a push-button 45 is further mounted in a round hole 47 so that it can move in the axial direction. A positioning ram 49 is mounted on the push-button 45 on the inside of the cover. The ram is guided in the longitudinal direction in a tubular extension 51 on the cover 13. In the bore hole in the tubular extension 51, a connecting member (not visible) is formed, in which the cam 53 attached to the positioning ram 49 engages.

Furthermore, a hook 55, whose hook-shaped end 57 contacts the end cap 59 of the positioning ram 49, is formed on the rocker 25 (not visible in FIG. 2; see FIGS. 3–7).

A switching cam 61 is hinged so that it can pivot on one of the two longitudinal guides 15. On the switching cam 61, a tab-shaped stop 65 is formed, which is pressed against the longitudinal guide 15 by a torsion spring 63. The switching cam 61 thus can pivot in only one direction, namely against the force of the spring 63. Two gliding surfaces 67 and 69, which are essentially perpendicular to each other, are formed on the switching cam 61 (cf. FIG. 3*b*).

In FIG. 2, sewing machine parts not belonging to the exchanging arrangement, namely the bobbin case 71 with the bobbin 73 inserted therein, and the hook base 75 are also shown. The hook base 75 is part of the hook system not shown in the figures.

The two shaft stumps 27, on which the rocker 25 is hinged (in FIG. 2 only one is visible), are used not only for a pivoting support of the rocker 25, but also for support of the cover 13 in the free arm 7 of the sewing machine 1.

In another configuration of the sewing machine 1 not described in more detail, the cover 13 can be configured so that it also takes over the function of the push-button 45.

The individual functions of the arrangement will be explained with reference to FIGS. 3–7.

Figure 3A:
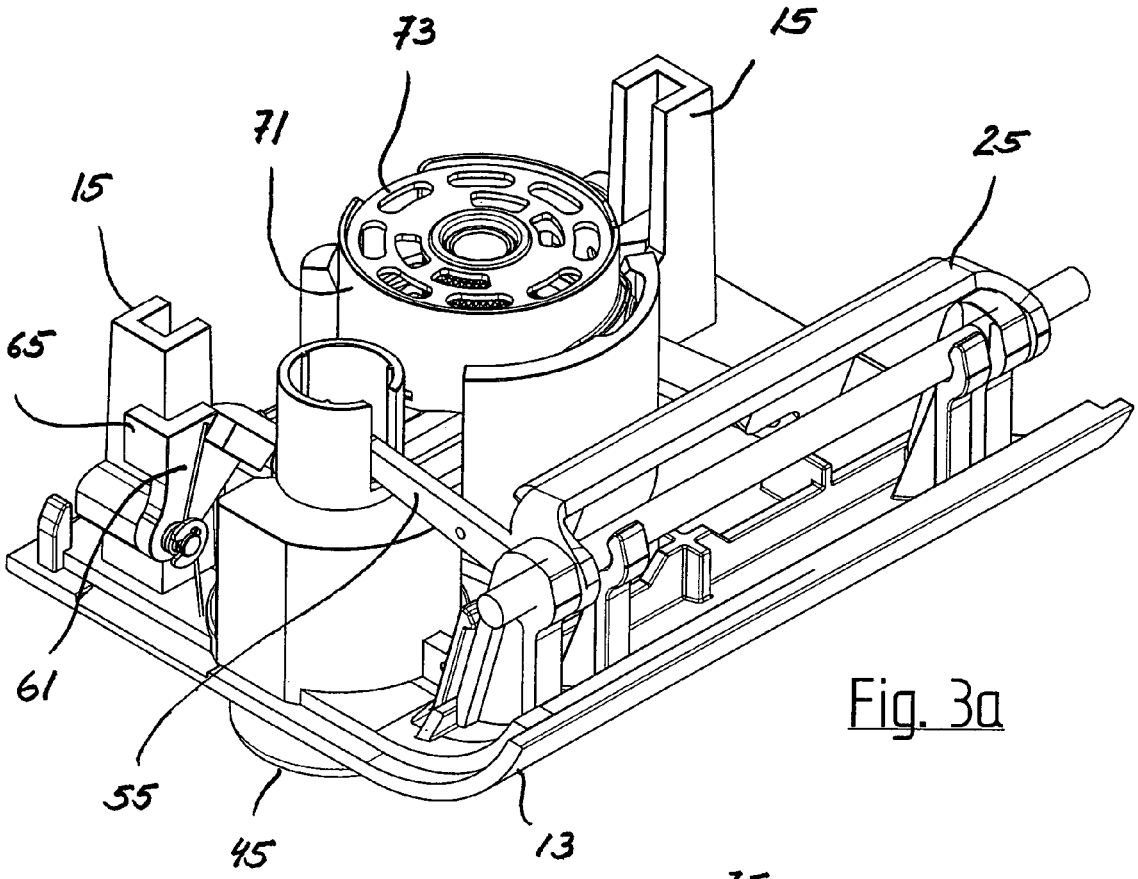
FIG. 3*a* is a perspective view of an open cover from the front with release and hold arrangement mounted thereon; removal position.

FIG. 3*a* shows the folded-up cover 13 diagonally from above with bobbin case 71 and bobbin 73 arranged therein still in the changing arrangement. Furthermore, the two longitudinal guides 15, which guide the slide 19, are easily recognizable. The push-button 45 is in its moved-out position. Consequently, the lever 55, which controls the position of the slide 19, is moved out slightly.

Figure 3B:
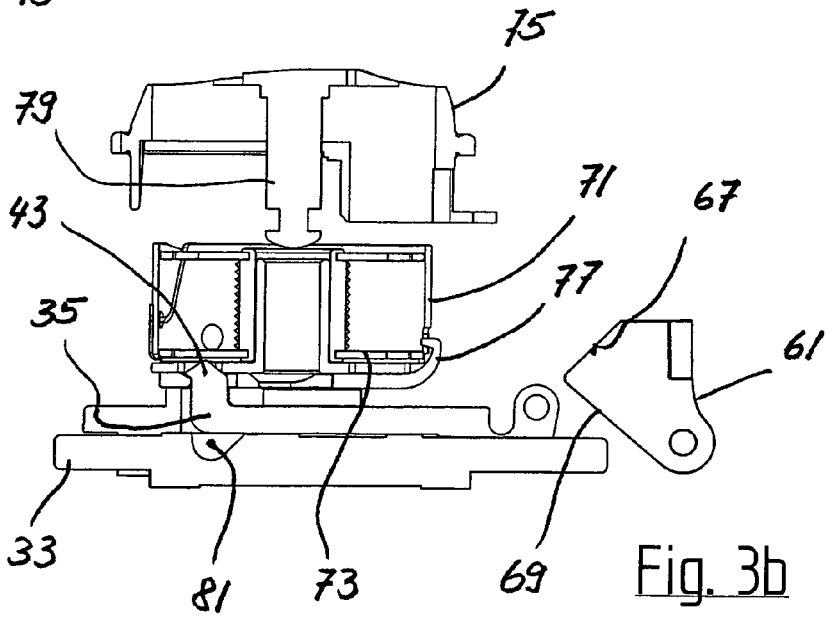
FIG. 3*b* is a view of the release and hold arrangement from above after the bobbin case moves out from the hook base.
Figure 3C:
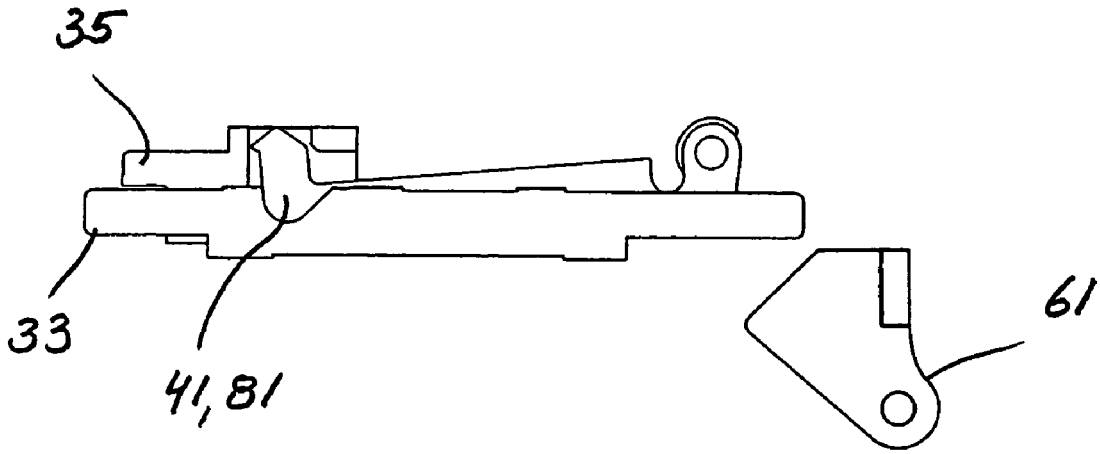
FIG. 3*c* is a view of the release and hold arrangement from above after the removal of the bobbin case.

In FIG. 3*b*, only the crossbar 33 and the unlocking latch 35, as well as the switching cam 61 of the changing arrangement, are visible. The cover 13 and other parts, which are not necessary for the explanation of the function, are missing. The catch hook 43 engages in the movable locking plate 77 on the bobbin case 71 and thus releases the lock between the bobbin case 71 and the hook base 75 or the mandrel 79 in the hook base 75. The bobbin case 71 can now be removed from the cover 13 and the bobbin 73 lying therein can be replaced by another bobbin. When the new bobbin case 71 is placed, the unlocking latch 35 pivots slightly downwards in the counter-clockwise direction and its guidance cam 41 comes to lie in a recess 81 in the crossbar 33 (see FIG. 3*c*).

Figure 4A:
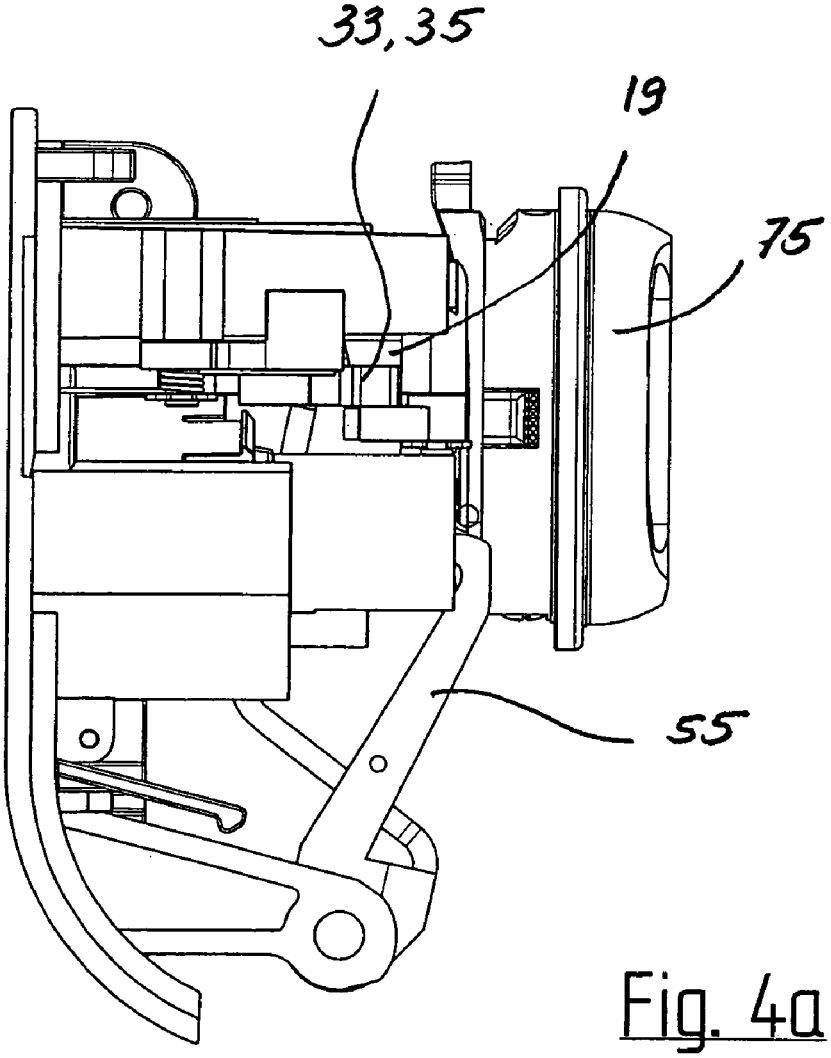
FIG. 4*a* is a view of the cover after inserting a full bobbin and closing the cover with a completely depressed push-button.
Figure 4B:
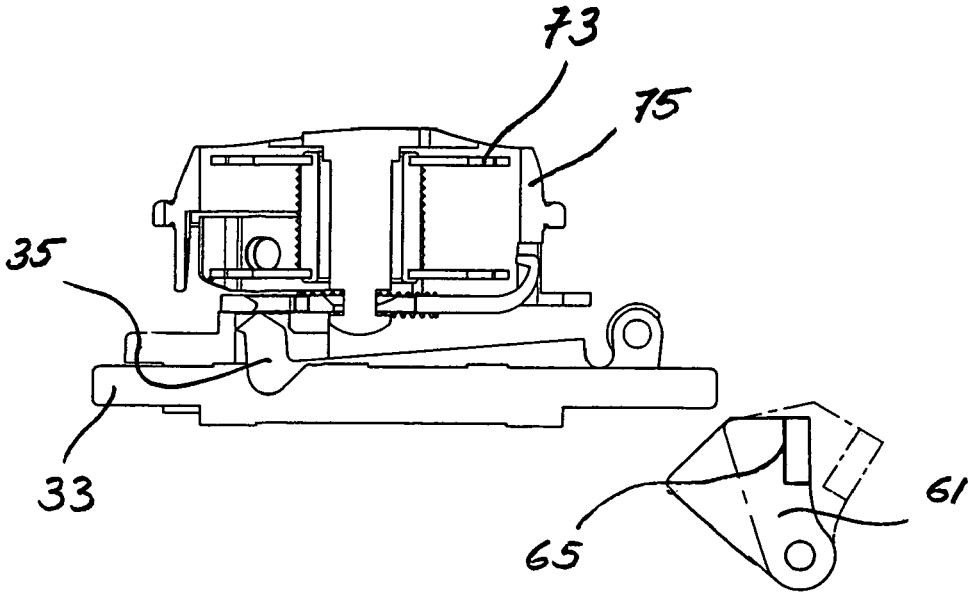
FIG. 4*b* is a view of the release and hold arrangement from above in FIG. 4*a*.

FIG. 4*a* shows the closed cover 13, after a bobbin case 71 with new bobbin 73 arranged therein has been set beforehand on the changing arrangement. The push-button 45 is completely depressed (and thus not visible above the surface of the cover 13) and the positioning ram 49 presses the lever 55 into its greatest possible outwards pivoted position. Therefore, the slide 19 with the crossbar 33 arranged thereon and the unlocking latch 35 is pushed to the right, so that the bobbin case 71 is completely pushed into the hook base 75. When the bobbin case 71 has been pushed into the hook base 75, the locking plate 77 is pushed to the side by the conical end of the mandrel 79 against the force of a spring (not shown) attached to the locking plate 77 and now locks in the groove 83 on the mandrel 79 (see FIG. 6*b*).

Figure 5A:
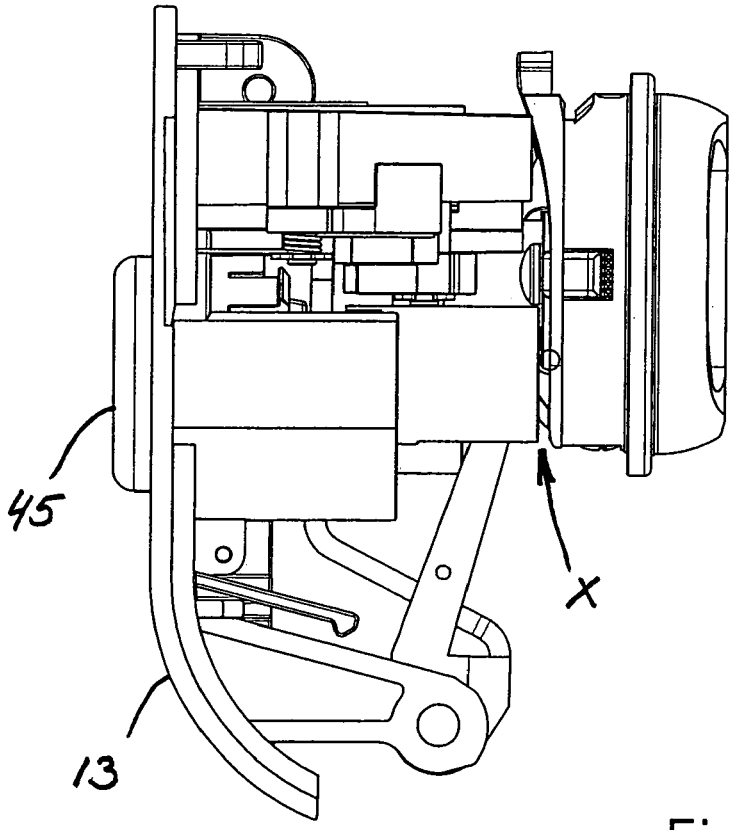
FIG. 5*a* is a side view of the cover for a released push-button and slider moved back into the middle position.
Figure 5B:
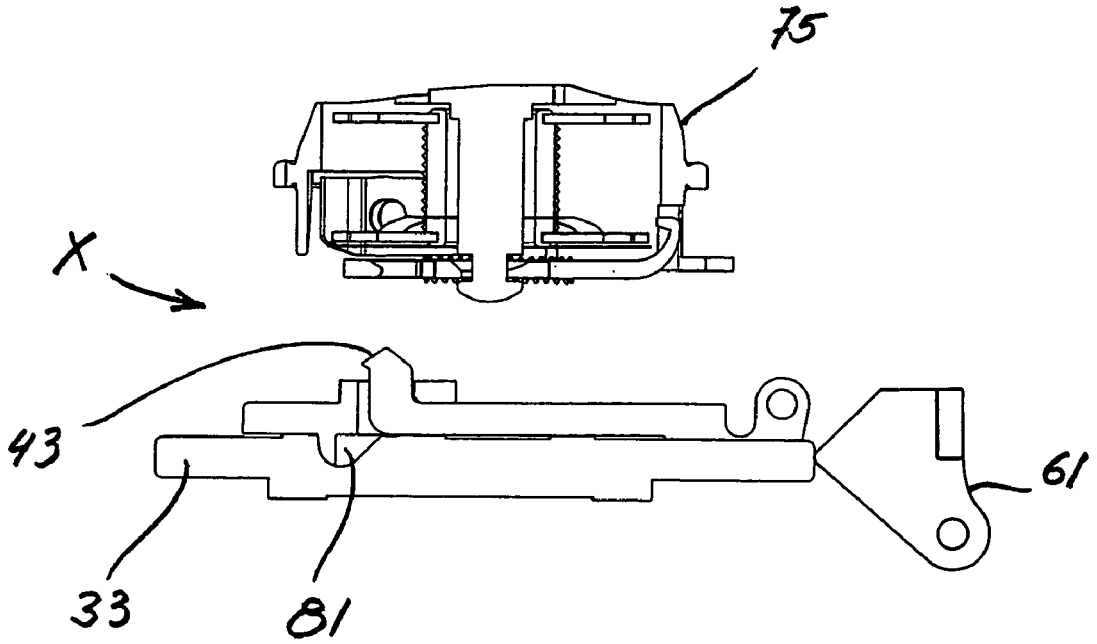
FIG. 5*b* is a view of the release and hold arrangement from above according to FIG. 5*a*.
Figure 6A:
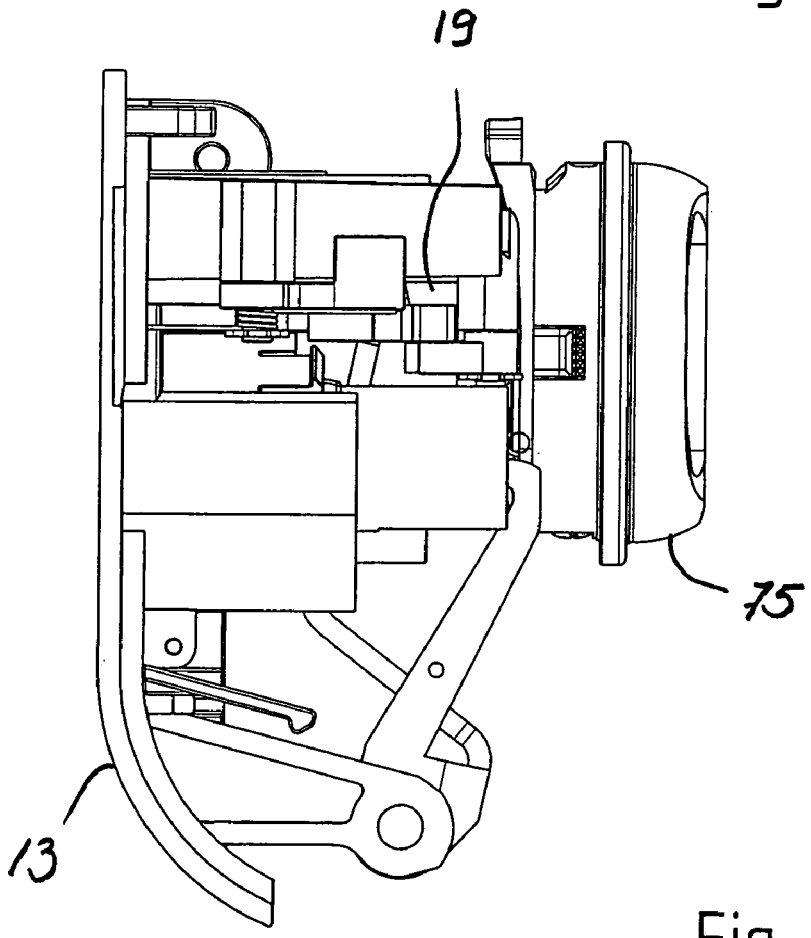
FIG. 6*a* is a side view of the cover with push-button that has been pressed again for unlocking and hooking the bobbin case.
Figure 6B:
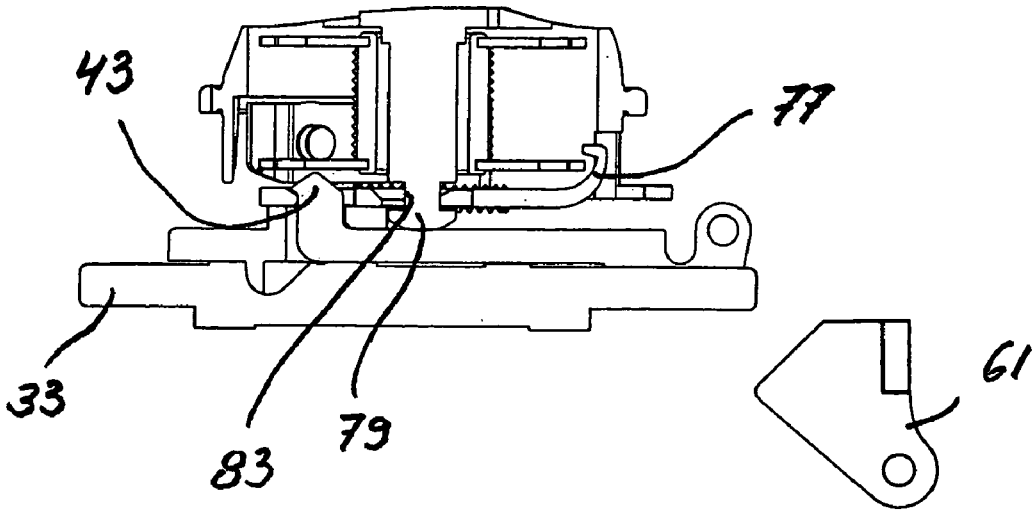
FIG. 6*b* is a view of the release and hold arrangement from above as in FIG. 6*a*.

After releasing the push-button 45, this moves back into a middle position (FIG. 5*a*) and the slide 19 with the crossbar and the unlocking latch moves to the left, so that a gap X is produced between the bobbin case 71 and the changing arrangement, which enables the passage of the thread loop during sewing. When the slide 19 moves back, the crossbar 33 mounted therein is moved to the left by the switching cam 61 (FIG. 5*b*) and lifts the guidance cam 41, which up to now was lying in the recess 81, so that the catch hook 43 is pushed forwards and is ready for the next bobbin changing procedure (FIG. 5*b*). In order to guarantee that the switching cam 61 is active only for the passage of the crossbar 33 from the side of the hook in the direction towards the user, it is attached elastically in the opposite direction. Therefore, it moves out of the way during the passage of the crossbar 33 (see FIG. 4*b*).

In order to allow the bobbin 73 to be removed from the hook base 75 if the bobbin 73 is empty or to change the thread color, the push-button 45 is in turn completely pressed into the cover 13 and therefore the slide 19 moves against the hook base 75. During the advance of the slide 19, the catch hook 43 penetrates into the locking plate 77 on the bobbin case 7 and locks this tight to the changing arrangement, so that for the subsequent release of the push-button 45 and opening of the cover 13, the bobbin case 71 with the bobbin 73 lying therein is moved out from the hook base 75 and thus from the hook. For sewing machines 1 without a bobbin case 71, only the bobbin 73 itself can be moved out from the hook base 75 accordingly.

Figure 7:
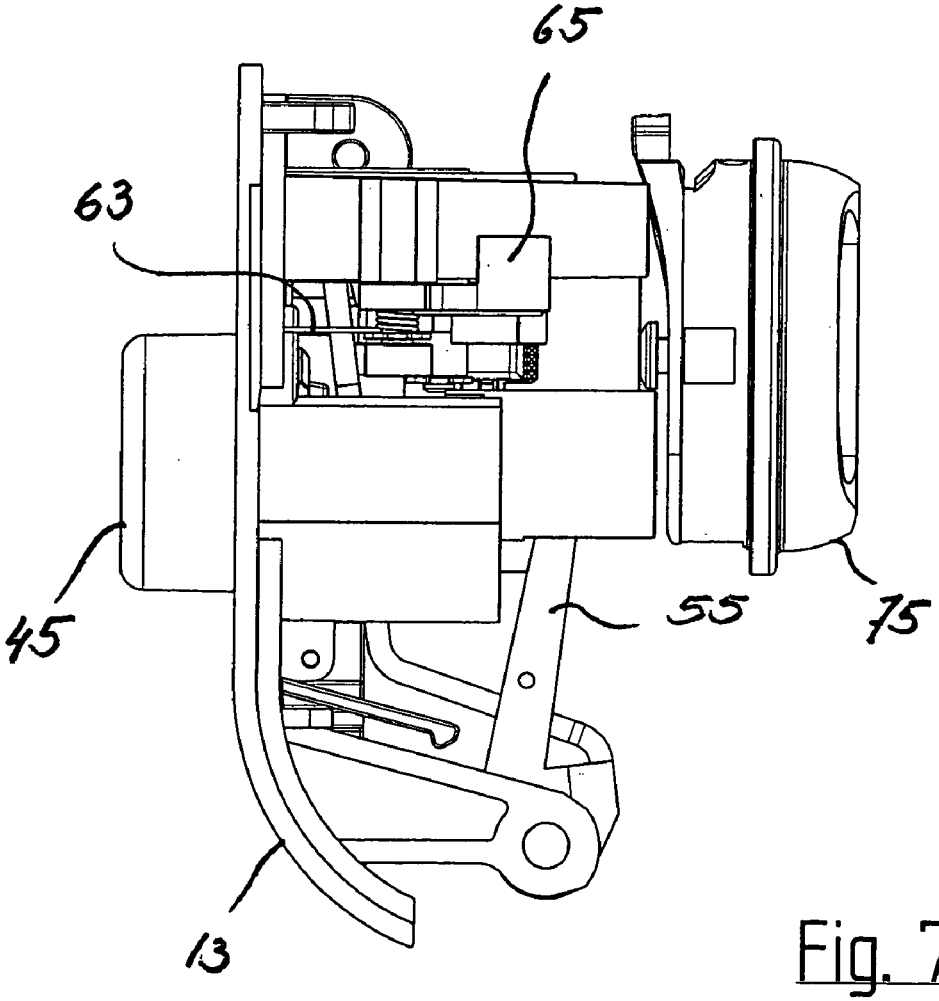
FIG. 7 is a side view of the cover with unloaded push-button before pivoting the cover into the position according to FIG. 3*a*.

The opening of the cover 13 can be performed automatically by a mechanism not shown or described in more detail when the push-button 45 is released or the cover 13 is opened in a conventional way (FIG. 7).

In the figures, the design of the push-button 45 and the positioning ram 43 is not described in more detail. The function of each corresponds to those of the activating mechanism of a ball-point pen, for which, after a first complete depression, the positioning ram is also moved completely forwards and then, guided back by a spring, remains in an intermediate position between the forwards and initial position. For the next complete activation of the push-button 45, the positioning ram is again all the way forwards and after release of the push-button 45 it is no longer in the intermediate or middle position, but instead it is moved back completely into the original position.

Obviously, the design of the push-button 45 could also be different, e.g., a rotary knob, which moves a positioning ram into a completely moved out position for each rotation through a predetermined rotational angle. The positioning ram is then held in an intermediate position and only returns into the original position with the next complete outwards movement. Alternatively, activation of the positioning ram 49 by an electrical linear drive is also possible, which assumes the desired positions with a press of a button.

It is also possible to trigger the opening of the cover 13 by electrical drive elements after the unlocking of the bobbin case 71 from the hook base 75.

LEGEND

| | |
|---|---|
| 1 | Household sewing machine |
| 2 | Base |
| 5 | Stand |
| 7 | Lower or free arm |
| 9 | Upper arm |
| 11 | Needle plate |
| 13 | Cover |
| 15 | U-shaped longitudinal guides |
| 17 | Grooves |
| 19 | Slide |
| 21 | Recesses |
| 23 | Rocker arm |
| 25 | Rocker |
| 27 | Shaft stumps |
| 29 | Pivot bracket |
| 31 | Bore hole |
| 33 | Crossbar |
| 35 | Unlocking latch |
| 37 | Bolt |
| 39 | Socket |
| 41 | Guidance cam |
| 43 | Catch hook |
| 45 | Push-button |
| 47 | Round hole |
| 49 | Positioning ram |
| 51 | Tubular extension |
| 53 | Cam |
| 55 | Lever |
| 57 | Hook-shaped end |
| 59 | End cap |
| 61 | Switching cam |
| 63 | Torsion spring |

-continued

| | |
|---|---|
| 65 | Stop |
| 67 | Sliding surface |
| 69 | Sliding surface |
| 71 | Bobbin case |
| 73 | Bobbin |
| 75 | Hook base |
| 77 | Locking plate |
| 79 | Mandrel |
| 81 | Recess |
| 83 | Groove |

The invention claimed is:

1. Arrangement for changing bobbins (73) in sewing and embroidery machines (1), comprising:

a bobbin case having a locking plate (77);

a support which is arranged to be moveable so that it extends out of a free arm (7) of a sewing machine through an opening in the free arm (7) that is exposed by an opened cover (13);

a movable body (19) movable between a first position spaced from a hook base (75) and a second position in proximity to the hook base (75) for moving a bobbin case (71) with a bobbin (73) out of the hook base (75) and for conveying the bobbin (73) into a changing position corresponding to the first position of the movable body, the movable body (19) being mounted on the support; and a latch (35) connected to the movable body (19) for removably connecting to the bobbin case (71) in the second position, the latch (35) comprises a catch hook (43), which is mounted for movement to a position near the bobbin case (71) to release the locking plate (77) located thereon from engagement with the hook base (75) and to connect the bobbin case (71) to the movable body (19) for movement to the first position.

2. Arrangement according to claim 1, wherein the cover (13) is integrally connected to the support.

3. Arrangement according to claim 2, wherein the cover (13) is hinged so that it can pivot on the free arm (7) of the sewing machine (1) and/or is mounted so that it can move on the free arm (7).

4. Arrangement according to claim 1, further comprising an activation mechanism connected to the cover (13) and connected to the movable body (19) for moving the movable body (19) through at least the first and second positions.

5. Arrangement according to claim 4, wherein a push-button (45) is mounted in the cover (13) as at least a portion of the activation mechanism or the cover (13) itself acts as at least a portion of the activation mechanism.

6. Arrangement according to claim 4, wherein after unlocking the bobbin (73) from the hook base (75), the bobbin (73) is moved out from the hook base (75).

* * * * *